United States Patent [19]

Dropczynski

[11] Patent Number: 4,726,533

[45] Date of Patent: Feb. 23, 1988

[54] METHOD OF AND APPARATUS FOR THE AUTOMATIC POSITIONING OF A WEB-WINDING CORE IN A DOUBLE-ROLL COILING MACHINE

[75] Inventor: Hartmut Dropczynski, Dormagen, Fed. Rep. of Germany

[73] Assignee: Jagenberg Aktiengesellschaft, Dusseldorf, Fed. Rep. of Germany

[21] Appl. No.: 870,003

[22] Filed: Jun. 3, 1986

[30] Foreign Application Priority Data

Jul. 31, 1985 [DE] Fed. Rep. of Germany ..... 3527377

[51] Int. Cl.[4] ..... B65H 19/30; B65H 19/12

[52] U.S. Cl. ..... 242/56 R; 242/66

[58] Field of Search ..... 242/56 R, 66

[56] References Cited

U.S. PATENT DOCUMENTS

| | | | |
|---|---|---|---|
| 4,183,474 | 1/1980 | Schonmeier | 242/66 |
| 4,304,368 | 12/1981 | Bartmann | 242/56 R |
| 4,338,147 | 7/1982 | Backstrom | 242/56 R X |
| 4,345,722 | 8/1982 | Kuhn | 242/66 X |
| 4,370,193 | 1/1983 | Knauthe | 242/66 X |
| 4,408,727 | 10/1983 | Dropczynski . | |
| 4,552,316 | 11/1985 | Dropczynski | 242/56 R |
| 4,572,451 | 2/1986 | Ikeda et al. | 242/56 R |
| 4,601,441 | 7/1986 | Oinonen et al. | 242/56 R |

FOREIGN PATENT DOCUMENTS 2920707 5/1979 Fed. Rep. of Germany .

*Primary Examiner*—Donald Watkins

*Attorney, Agent, or Firm*—Karl F. Ross; Herbert Dubno

[57] ABSTRACT

A method of and apparatus for the coiling of a web and positioning of a web-coiling core in the pocket of a double-roll coiling machine. The beam for removing the finished coil also carries the grippers for the core which is previously provided with glue to which the free end of the web severed from the finished coil can be adhered. A suction device maintains the orientation of the core after it is released by the grippers and as it moves from the transfer position to the coiling position.

10 Claims, 1 Drawing Figure

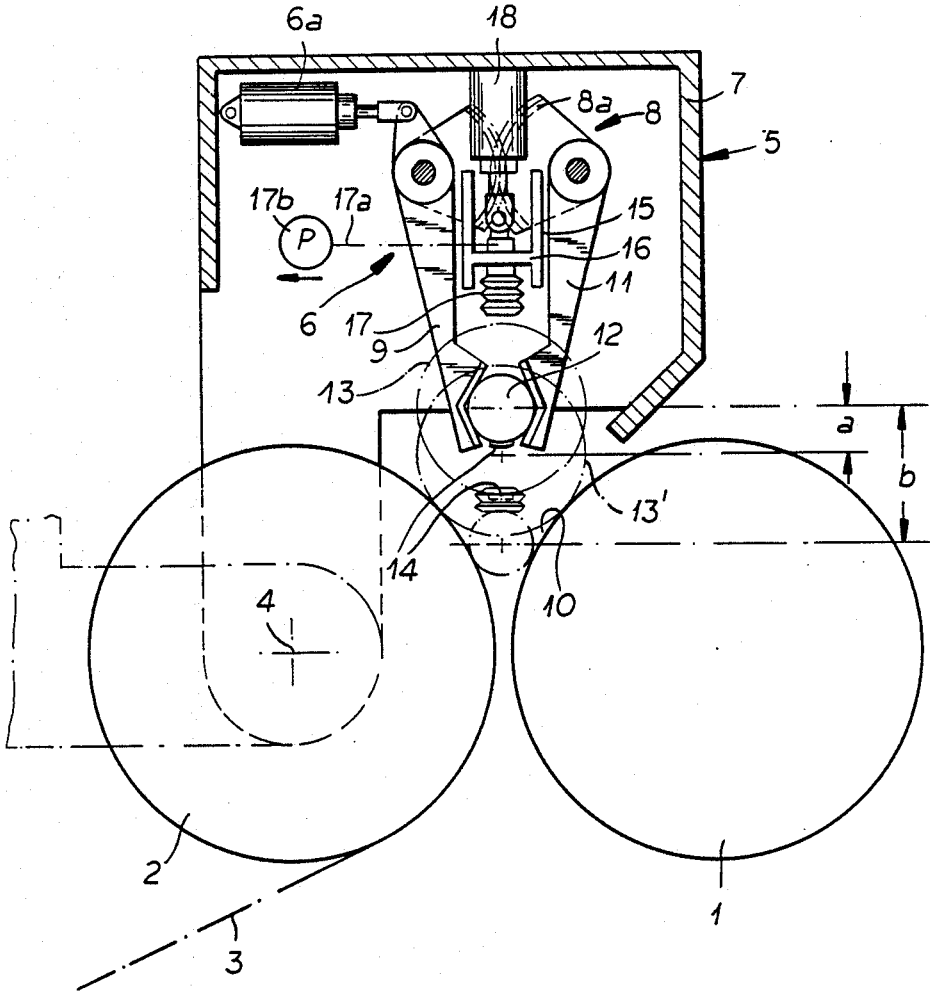
6a
18
7
8a
8
5
17b
17a
P
15
16
11
6
17
9
12
13
a
b
13'
14
10
4
2
1
3

METHOD OF AND APPARATUS FOR THE AUTOMATIC POSITIONING OF A WEB-WINDING CORE IN A DOUBLE-ROLL COILING MACHINE

FIELD OF THE INVENTION

My present invention relates to a method of automatically positioning a core of a double-roll web-winding machine in the pocket or cradle formed by the two rolls of such a winding machine.

The invention also relates to a double-roll-coiling apparatus with improved means for the automatic positioning of the core in the aforementioned pocket.

BACKGROUND OF THE INVENTION

It is known, e.g. from German patent document No. 29 20 707 and the corresponding U.S. Pat. No. 4,408,727, for example, to provide a process for automatically introducing a web-coiling core in the pocket defined by the support rolls of a double-roll-coiling machine in which the web, e.g. a paper web, is severed and the resulting free end of the paper web, after removal of the completed coil, is affixed to the web-coiling core. The latter is previously provided with an adhesive enabling the free end of the web to adhere to the core so that, when the core is positioned in the pocket so as to be cradled in the downwardly converging crevice between the rolls, also referred to as the wedge, rotation of the rolls can cause the web to wind upon the core and form another coil.

In the apparatus, moreover, the core is initially transferred from a waiting position, which is defined by the apparatus, into a transfer position in which the core is located above the pocket and is then transferred from the latter position onto the support rolls into the coiling or winding position.

The afore-described process and apparatus makes use of a holder for the core which comprises a pair of tongues or jaws which grip the core in the transfer position above the roll bed and carry the core into the pocket of bed. The core, of course, should be held in an exactly defined position so that the trace of adhesive or glue thereon can properly encounter the free end of the web which is to be applied thereto. Usually the glue trace or strip is downwardly oriented.

However, in practice, the gripper which has retained the core in its transfer position opens to allow the core to pass by free fall into the pocket and onto the rollers. In most cases, the glue trace or adhesive strip, if properly oriented on the undersides of the core, will simply enter the crevice formed by the roll bed without problems. The glue trace or adhesive strip does not come into contact with the support rolls and directly adheres the free end of the web to the core. However, this is not always the case in practice, when one utilizes web-coiling cores of large outer diameter, the grippers for the cores must be located substantially higher above the bed and thus the core must pass through a greater free fall before being caught by the rolls.

Naturally, if the grippers are positioned at such higher levels to accomodate larger diameter cores, then when the apparatus is used for smaller diameter cores, the free fall distance is even greater.

Especially in the latter case, i.e. when small cores are used in an apparatus capable of handling large cores, the free fall, in particular upon the rolls and even the free fall itself induces a rotation in the core which can cause the adhesive or glue on the core to contact one or the other roll and contaminate it. Contamination is also possible in this manner of any pressure roll which may be provided to apply pressure to the core.

OBJECTS OF THE INVENTION

It is the principal object of the present invention to provide an improved method of automatically supplying a web-coiling core to a double-roll-coiling machine whereby the afore-described drawbacks are avoided and especially, the danger of contamination of rolls or other parts of the machine with glue or adhesive from the new core is excluded.

Another object of the invention, is to provide an improved apparatus, namely an improved double-support-roll-web-coiling apparatus with automatic core positioning which will preclude such contamination.

Still another object of the invention is to provide an improved method of and apparatus for the positioning of a core in a double-roll-coiling machine, whereby an exact orientation of the core on the roll bed can be ensured.

SUMMARY OF THE INVENTION

These objects and others which will become more apparent herein are attained in accordance with the invention by restraining the web-coiling core during its movement from the transfer position to the coiling or winding position against rotation, i.e. by holding this sleeve against rotation during the transfer. In this manner, the winding core is no longer able to rotate, or twist in an uncontrolled manner, but can be transferred in its precise orientation with which it was held in the waiting position and brought into the transfer position, also from the transfer position to the coiling or winding position.

Consequently, contamination of the support rolls is avoided and an unobjectionable coiling of the web is ensured.

The invention has been found to be most advantageous when the system operates with a plurality of adjacent coiling sleeves or core pieces, i.e. in such cases where other means, for example, hooks engaging the core ends or the like, cannot be used.

Advantageously, the restraining of the coiling cores against rotation is effected by suction and the suction is applied while the cores are still in their transfer positions, i.e. held by the clamping device.

This provides ensurance that the original position of the winding core or sleeve established in the waiting position and retained in the transfer position will be maintained as the core is delivered to the coiling position.

According to the invention, a double-support-roll web-coiling apparatus can comprise a pair of support rolls forming a pocket for cradling a web-coiling core therein, means for feeding to this pocket a leading edge of a web to be coiled and adapted to be bonded by an adhesive to the core, and core-supply means.

According to the invention, the core-supply means initially holds the web-coiling core in a defined waiting position and in a given core orientation, then moves the web-coiling core positively to a transfer position above the pair of rolls and thereafter inserts the web-coiling core into the pocket formed between the rolls, suction means being provided for restraining the core from rotating while the core is shifted between the transfer position and the winding position.

The restraining means allows winding cores of different diameters to be held in exactly defined orientation from the transfer position to the winding position and precludes uncontrolled rotation or twisting of the winding cores.

The suction means can comprise a bar provided with a plurality of spaced-apart suction cups connected to a suction or vacuum source and means for lowering the bar and hence the suction cups onto the core while the latter is clamped in the transfer position so that the suction will retain the core while the entire suction arrangement including bar and cups follow the core from the transfer position to the pocket defined between the rolls.

It has been found to be advantageous to provide a guide for this bar and an element for displacing it, such as a telescoping cylinder arrangement.

According to a feature of the invention, the telescoping cylinder arrangement is mounted on a beam or housing which is swingable about the axis of one of the support rolls and which can be provided with the gripper for holding the core as it is transferred from the waiting position to the transfer position. This unit can also serve to discharge the finished coil when the latter is fully wound.

When a gripper is provided, the gripper jaws are preferably disposed symmetrically with respect to the axis of the telescoping cylindrical arrangement.

BRIEF DESCRIPTION OF THE DRAWING

The above and other objects, features and advantages of the present invention will become more readily apparent from the following description, reference being made to the accompanying drawing, the sole FIGURE of which is a diagrammatic vertical section through a portion of a double-roll web-coiling apparatus embodying the invention.

SPECIFIC DESCRIPTION

The broad principles under which a double-roll-web-coiling apparatus operates are further set forth in U.S. Pat. No. 4,408,727, which is incorporated herein by reference and, as in that apparatus, when the head for inserting a new core has been swung out of the way, a pressure roller can apply pressure to the top of the coil being wound in the pocket or "wedge" between the rolls. The apparatus is particularly effective for the winding of rolls of paper on cores in the form of cardboard sleeves which have previously been provided with glue or adhesive in a continuous strip or at several spaced-apart locations.

The only parts of the double-roll-coiling machine which are illustrated herein, therefore, are the rotation support rolls 1 and 2, the support roll 2 having a perforated surface so that it can be placed under suction and hold the paper web 3 until it is carried to the core and adheres thereto for coiling on the support rolls 1 and 2 are driven in opposite senses.

The discharge mechanism represented at 5 comprises a beam or housing which is swingable about the rotation axis 4 of the support roll 2 and has integrated therein a core transfer unit 6.

The dot-dash line showing of the core 12 shows the coiling position for a small diameter core while the solid line position shows shows the core in its transfer position. The dot-dash line showing of the housing 5, of course, represents the waiting position, the housing being swung in a clock-wise sense from the waiting position to carry the core into the transfer position. At 13, in dot-dash lines, the transfer position of a larger diameter core has been shown and the winding position of this core has been illustrated at 13'.

The discharge unit 5 comprises a beam 7 which can transfer the formed coils to a collecting table (not shown) in any conventional manner.

The core insertion unit 6 comprises gripper tongues 8 whose jaws 9, 11 can engage cores of different diameters and can hold them in the transfer position after receiving them in the waiting position. A cylinder unit **6*a* operates the jaws which are coupled by gear sectors 8*a* for reciprocal movement to allow the cores to drop into the pocket or wedge 10 formed between the rolls 1 and 2**.

The cores, as noted, must be held in their original orientation so that the glue or adhesive trace 14, as the core is placed in the pocket, will not contact the surface of the drop and for this purpose, disposed centrally to the jaws 9, 11 of the gripper arrangement 8, I provide a restraining device 15 which has a vertically guided bar 16 provided with guide means engageable with flanks of the bar or formed with a shifting unit 18 in the form of a telescoping cylinder arrangement. The bar 16 carries a plurality of spaced-apart suction cups, one of which can be seen at 17 which are connected as represented by the dot-dash line 17 to a suction source **12*b***.

The double-roll-coiling machine operates as follows:

When a finished coil is removed from the pocket between the rolls 1 and 2 and the web is severed, the free end of the web 3 remains adhered by suction to the roll 2. For the transfer of the finished roll, the beam 7 carrying the transfer means (not shown) is swung from its waiting position illustrated in dot-dash lines, into its solid line transfer position illustrated as the finished roll is delivered to a table, which has also not been shown.

However, since the core insertion unit 6 is coupled with the discharge unit 5, during this movement, a core 12 or 13, held in its defined orientation by the gripper 8 is carried from its waiting position to its transfer position as illustrated in the drawing.

In the illustrated transfer position the glue trace 14 is turned downwardly.

The jaws 9 and 11 are thereupon moved apart to permit the core to descend into the pocket. However, shortly before the opening of the gripper 8 and while the core is retained in the gripper, the retaining unit 15 is operated to lower the suction cups 17 onto the core 12 or 13, whereupon suction is applied by the pump **17*b***.

With opening of the grippers, via the telescoping cylinder unit 18, the suction cups 17 and bar 16 are lowered with the core 12 or 13 until the core is supported by the rolls 1 and 2, while maintaining the orientation of the core and hence ensuring that the glue trace will be between the rolls.

The dimension a in the drawing represented the descent of a large diameter core while the diameter b shows the descent of the small diameter core and, in either case, the orientation of the chore is maintained.

The head 5 can then be swung out of the way to allow a pressure roller to hold the core against the support rolls as rotation of them brings the glue strip into contact with the paper web and then permits coiling in the usual manner.

I claim:

1. In a method of automatically supplying a web-coiling core to a double-roll coiling machine in which the web is severed and the resulting leading web edge, following ejection of the previous coil, is applied with an adhesive to the core which is initially held in a defined waiting position and is then moved positively to a transfer position above a pair of rolls of said double-roll coiling machine and is thereafter inserted into a pocket formed between said rolls to be cradled thereby, the improvement which comprises the step of restraining said core from rotation while said core is shifted between said transfer position to said winding position by applying suction to the core.

2. The improvement defined in claim 1 wherein the restraining of said core from rotation is initiated while said core is in said waiting position and is maintained as said core is moved positively from said waiting position to said transfer position.

3. A double-support-roll web-coiling apparatus, comprising:

a pair of support rolls forming a pocket for cradling a web-coiling core therein;

means for feeding to said pocket a leading edge of a web to be coiled and adapted to be bonded by an adhesive to said core;

core-supply means for initially holding said web-coiling core in a defined waiting position, then moving said web-coiling core positively to a transfer position above said pair of rolls of said double-roll coiling machine, and thereafter inserting said web-coiling core into said pocket formed between said rolls to be cradled thereby; and means for restraining said core from rotation while said core is shifted between said transfer position to said winding position, said means for restraining comprising a suction mechanism acting on said core.

4. The double-support-roll web-coiling apparatus defined in claim 3 wherein said suction mechanism acting on said core comprises a bar provided with a suction cup engageable with said core and connected to a suction source.

5. The double-support-roll web-coiling apparatus defined in claim 4 wherein said bar is displaceable in a guide toward and away from said pocket, said means for restraining further comprising means for shifting said bar.

6. The double-support-roll web-coiling apparatus defined in claim 5 wherein said means for shifting said bar comprises a telescoping cylinder arrangement coupled to said bar.

7. The double-support-roll web-coiling apparatus defined in claim 5, further comprising a mount for said suction mechanism swingable about an axis of one of said rolls for displacing said core from said waiting position to said transfer position, said core-supply means being provided on said mount.

8. The double-support-roll web-coiling apparatus defined in claim 7 wherein said mount forms part of a coil-removal mechanism for removing a finished coil from which said end is severed.

9. The double-support-roll web-coiling apparatus defined in claim 7 wherein said core-supply means includes oppositely movable clamping jaws engageable with said core and disposed so as to be centered on an axis of said telescoping cylinder arrangement.

10. A method of automatically supplying a web-coiling core to a double-roll coiling machine, comprising the steps of:

removing a complete web coil and severing the web to form a leading web edge; applying an adhesive to a web-winding core;

intially holding said core to which the adhesive has been applied in a defined waiting position;

then moving saif web-winding core positively to a transfer position above a pair of rolls of said double-roll coiling machine;

thereafter inserting said web-winding core into a pocket formed between said rolls to be cradled thereby; and restraining said core from rotation by applying suction thereto at least while said core is shifted between said transfer position to said winding position.

* * * * *